US006296366B1

(12) United States Patent
Hopps

(10) Patent No.: US 6,296,366 B1
(45) Date of Patent: Oct. 2, 2001

(54) LIGHTED DECORATIVE ARTICLE HAVING MERIDIAN-CONFIGURED LOOPS AND METHOD FOR VISUALLY SIGNALING LOCATION OF GIFT PACKAGES

(76) Inventor: Gregory Lee Hopps, 5230 Manhasset Dr., San Diego, CA (US) 92115

( * ) Notice: Subject to any disclaimer, the term of this patent is extended or adjusted under 35 U.S.C. 154(b) by 0 days.

(21) Appl. No.: 09/260,425

(22) Filed: Mar. 1, 1999

(51) Int. Cl.[7] ..... F21L 15/08
(52) U.S. Cl. ..... 362/154; 362/806; 428/5
(58) Field of Search ..... 362/184, 154, 362/806, 800; 40/564, 571, 574; 428/5

(56) References Cited

U.S. PATENT DOCUMENTS

| | | | |
|---|---|---|---|
| D. 184,477 | 2/1959 | Flaster . | |
| D. 214,231 | 5/1969 | Schmidt . | |
| D. 249,486 | 9/1978 | Del Grosso . | |
| D. 258,946 | 4/1981 | Del Grosso . | |
| D. 268,743 | 4/1983 | Lubin . | |
| D. 284,487 | 7/1986 | Pratt . | |
| D. 295,731 | 5/1988 | Mancel . | |
| D. 298,306 | 11/1988 | Hunstiger . | |
| D. 311,156 | 10/1990 | Cheng . | |
| D. 313,373 | 1/1991 | Taylor . | |
| D. 317,733 | 6/1991 | Cheng . | |
| D. 321,153 | 10/1991 | Cheng . | |
| D. 328,767 | 8/1992 | Keives . | |
| D. 331,728 | 12/1992 | Chen . | |
| D. 333,639 | 3/1993 | Matan . | |
| D. 333,802 | 3/1993 | Stabler . | |
| D. 338,628 | 8/1993 | Daun . | |
| D. 340,677 | 10/1993 | Cheng . | |
| D. 342,219 | 12/1993 | Cheung . | |
| D. 342,464 | 12/1993 | Lardiere et al. . | |
| D. 342,921 | 1/1994 | Cheng . | |
| D. 343,143 | 1/1994 | Cheng . | |
| D. 344,045 | 2/1994 | Cheng . | |
| D. 347,406 | 5/1994 | Mooney et al. . | |
| D. 350,312 | 9/1994 | Edwards . | |
| D. 350,313 | 9/1994 | Edwards . | |
| D. 375,280 | 11/1996 | Murphy . | |
| D. 376,770 | 12/1996 | Vasquez . | |
| D. 386,719 | 11/1997 | Cheng . | |
| D. 390,808 | 2/1998 | Balde . | |
| D. 390,809 | 2/1998 | Etzion . | |
| 1,652,855 | 12/1927 | Fernandez . | |
| 1,773,580 | 8/1930 | Franke . | |
| 2,562,919 | 8/1951 | James . | |
| 2,792,655 | 5/1957 | Kroczynski et al. . | |
| 2,880,540 | 4/1959 | Williams . | |
| 3,112,240 | 11/1963 | Kravig et al. . | |
| 3,143,259 | 8/1964 | Paar . | |
| 3,630,810 | 12/1971 | Mauro . | |
| 3,637,452 | 1/1972 | Sanders . | |
| 3,732,414 * | 5/1973 | Franc | 362/806 |
| 3,770,543 | 11/1973 | Darabant . | |

(List continued on next page.)

OTHER PUBLICATIONS

Different Looks 1992 Christmas Catalog (1992).

Different Looks Brochure Entitled "Elegant Ribbons & Bows" (undated).

Different Looks Brochure Entitled "The Valentine's Collection" (undated).

*Primary Examiner*—Thomas M. Sember
(74) *Attorney, Agent, or Firm*—Drinker Biddle & Reath LLP

(57) ABSTRACT

A decorative article for gift packages includes meridian-configured loops connected together to define a generally open interior within the loops. The article further includes an electrical lamp within the interior connected to a battery by wire having sufficient length for the battery to reside inside the package with the meridian-configured loops positioned on the exterior of the package. The loops may be made of ribbon having a surface which is reflective, partially translucent, metallic or metalized.

8 Claims, 2 Drawing Sheets

U.S. PATENT DOCUMENTS

| | | | |
|---|---|---|---|
| 3,832,841 | 9/1974 | Cole . | |
| 3,850,293 | 11/1974 | Scaringi . | |
| 3,922,407 | 11/1975 | Nimmo, Jr. et al. . | |
| 3,959,535 | 5/1976 | Stewart . | |
| 4,055,840 | 10/1977 | Uchytil et al. . | |
| 4,201,806 | 5/1980 | Cole . | |
| 4,283,797 | 8/1981 | Seider | 2/151 |
| 4,339,059 | 7/1982 | Kenyon . | |
| 4,398,237 | 8/1983 | Doyel | 362/186 |
| 4,476,167 | 10/1984 | Duftler . | |
| 4,528,217 | 7/1985 | Spathis et al. . | |
| 4,554,114 | 11/1985 | Glen et al. . | |
| 4,585,114 | 4/1986 | Liliano . | |
| 4,726,509 | 2/1988 | Fonas . | |
| 4,780,343 | 10/1988 | Coffman . | |
| 4,809,353 | 2/1989 | Cheng . | |
| 4,812,338 | 3/1989 | Masui . | |
| 4,822,648 | 4/1989 | Cheng . | |
| 4,840,822 | 6/1989 | Cheng . | |
| 4,886,687 | 12/1989 | Malott . | |
| 4,895,741 | 1/1990 | Coffman . | |
| 4,900,632 | 2/1990 | McGrath . | |
| 4,910,051 | 3/1990 | Pickering et al. . | |
| 4,915,996 | 4/1990 | Curry . | |
| 4,919,980 | 4/1990 | Pirkey . | |
| 4,937,106 | 6/1990 | Eliason . | |
| 4,938,348 | 7/1990 | Cheng . | |
| 4,948,636 | 8/1990 | Lyons . | |
| 4,957,784 | 9/1990 | Ripamonti . | |
| 4,967,321 | 10/1990 | Cimock . | |
| 4,968,540 | 11/1990 | Linsenbigler . | |
| 5,004,144 | 4/1991 | Selga . | |
| 5,075,830 | 12/1991 | Perez | 362/352 |
| 5,079,046 | 1/1992 | Kessler | 428/4 |
| 5,100,706 | 3/1992 | Zaweski . | |
| 5,114,761 | 5/1992 | Doherty . | |
| 5,117,344 | 5/1992 | Perez | 362/352 |
| 5,156,893 | 10/1992 | Barthe . | |
| 5,228,686 | 7/1993 | Maleyko | 273/58 G |
| 5,240,750 | 8/1993 | Cheng . | |
| 5,292,003 | 3/1994 | Baghdassarian . | |
| 5,315,492 | 5/1994 | Davenport | 362/122 |
| 5,387,446 | 2/1995 | Weder . | |
| 5,411,774 | 5/1995 | Weder . | |
| 5,468,523 | 11/1995 | Huss et al. . | |
| 5,470,620 | 11/1995 | Weder . | |
| 5,484,496 | 1/1996 | Hackenberg . | |
| 5,508,901 | 4/1996 | Kuo | 362/122 |
| 5,526,243 | 6/1996 | Masters | 362/122 |
| 5,545,445 | 8/1996 | Cheng . | |
| 5,558,422 | 9/1996 | Sanford | 362/32 |
| 5,567,037 | 10/1996 | Ferber | 362/104 |
| 5,567,486 | 10/1996 | Weder . | |
| 5,605,728 | 2/1997 | Weder . | |
| 5,609,411 | 3/1997 | Wang | 362/234 |
| 5,609,928 | 3/1997 | Yedlin et al. . | |
| 5,614,274 | 3/1997 | Huss . | |
| 5,628,846 | 5/1997 | Huss et al. . | |
| 5,645,902 | 7/1997 | Cheng . | |
| 5,679,415 | 10/1997 | Weder . | |
| 5,679,416 | 10/1997 | Cheng . | |
| 5,683,762 | 11/1997 | Banschick . | |
| 5,693,381 | 12/1997 | Cheng . | |
| 5,800,881 | 9/1998 | Etzion . | |
| 5,918,964 | 7/1999 | Bou | 362/186 |
| 5,921,674 | 7/1999 | Koczi | 362/800 |
| 5,980,062 * | 11/1999 | Bell | 362/806 |
| 6,017,132 | 1/2000 | Miller et al. | 362/252 |
| 6,020,823 | 1/2000 | DeCicco | 340/691.2 |

* cited by examiner

LIGHTED DECORATIVE ARTICLE HAVING MERIDIAN-CONFIGURED LOOPS AND METHOD FOR VISUALLY SIGNALING LOCATION OF GIFT PACKAGES

BACKGROUND OF THE INVENTION—Field of the Invention

This invention relates to decorative articles used to provide enhancement of the decorative effect provided by gift wrapped packages and to methods and techniques for visually signaling location of gift packages.

BACKGROUND OF THE INVENTION—Description of the Prior Art

Ribbon, bows and gift wrap paper are known for use to provide decorative enhancement for gift articles, particularly at holidays such as Christmas, Valentines day and on birthdays.

While gift wrapping paper, ribbon and, more recently, pre-tied bows have been used to provide aesthetically pleasing effects for gifts, there is continuing demand for improved and even more aesthetically pleasing effects for association with gift packages. Indeed, consumers exhibit an almost insatiable appetite for more elaborate decor and ornamentation, to make ever more spectacular displays of gifts for exchange at Christmas time, particularly on Christmas morning.

Decorative bow design is a well developed art as exemplified by a number of United States design patents which issued for bows of various forms. The following United States design patents relating generally to bows, represent prior art with respect to this invention: U.S. Pat. Nos. D390,809; D390,808; D386,719; D376,770; D375,280; D350,313; D350,312; D347,406; D344,045; D347,406; D344,045; D343,143; D342,921; D342,464; D342,219; D340,677; D338,628; D333,802; D333,639; D331,728; D328,767; D321,153; D317,733; D313,373; D311,156; D284,487; D298,306; D295,731; D268,743; D258,946 and D249,486.

Additionally evidencing the state of development of the decorative bow art are the following United States utility patents representing prior art with respect to this invention: U.S. Pat. Nos. 5,800,881; 5,693,381; 5,683,762; 5,679,416; 5,679,415; 5,645,902; 5,628,846; 5,614,274; 5,609,928; 5,605,728; 5,567,486; 5,545,445; 5,484,496; 5,470,620; 5,468,523; 5,411,774; 5,387,446; 5,292,003; 5,240,750; 5,156,893; 5,114,761; 5,100,706; 4,967,321; 4,957,784; 4,948,636; 4,938,348; 4,937,106; 4,910,051; 4,900,632; 4,895,741; 4,886,687; 4,840,822; 4,822,648; 4,812,338; 4,809,353; 4,780,343; 4,726,509; 4,585,114; 4,554,114; 4,528,217; 4,476,167; 4,339,059; 4,055,840; 3,959,535; 3,922,407; 3,850,293; 3,770,543 and 3,630,810.

Non-patent prior art possibly relevant to the patentability of the instant invention includes a 1992 Christmas catalog entitled "Different Looks" distributed by Berwick Industries, Inc., a catalog flyer entitled "Elegant Ribbons & Bows—Different Looks" distributed circa 1992 by Berwick Industries, Inc. and a twelve page catalog entitled "The Valentine's Collection—Different Looks" distributed circa 1992 by Berwick Industries, Inc.

SUMMARY OF THE INVENTION

In one of its aspects, this invention embraces an article for providing decorative addition to gift packages where the article preferably includes a plurality of preferably meridian-configured loops connected together preferably to define a generally open interior within the meridian-configured loops. The article further preferably includes at least one preferably blinking electrical lamp in the open interior within the meridian-configured loops and preferably connected to at least one of the meridian-configured loops. The article yet further preferably includes at least one battery for powering the lamp and wire connecting the lamp to the battery or other power source with the wire preferably being of sufficient length that the battery may reside within the interior of a rectangular gift package hidden from view or may otherwise be positioned remotely from the meridian-configured loops, with the lamp(s) preferably being positioned on the upper exterior of the package. The article may optionally further include switch means connected to the wire for selectably interrupting electrical connection of the battery or other power source with the lamp(s).

The meridian-configured loops may be of different sizes. In all cases at least some of the meridian-configured loops are preferably connected facingly together.

The meridian-configured loops preferably collectively define a sphere-like shape. Where the loops are of different size, the outermost, preferably largest meridian-configured loops preferably collectively define a sphere-like envelope enclosing smaller meridian-configured loops therewithin.

Some of the meridian-configured loops may be twisted. The meridian-configured loops are preferably connected collectively together at a common location in facing contact one with another.

Preferably at least some of the meridian-configured loops are in vertical planes and the vertical planes are preferably at random angles one to another.

The meridian-configured loops are preferably formed of material strips having essentially unlimited length, finite width and minimal thickness relative to their width. The strips may preferably be from about one-sixteenth (1/16th) of an inch to about two (2) inches wide; diameter of the meridian-configured loops may range up to six (6) inches or even more.

The width of the material from which a meridian-configured loop is manufactured may vary within the meridian-configured loop.

The lamps are preferably connected to at least some of the meridian-configured loops proximate the location of common meridian-configured loop securement.

The meridian-configured loops are preferably ribbon. The ribbon is preferably opaque or at least substantially opaque and preferably highly reflective. The ribbon may also be partially or fully translucent, fully or partially transparent or have some combination of opaque, transparent and translucent portions.

If the ribbon is at least partially translucent, at least a part of the translucent portion of the ribbon preferably directly faces at least one of the lamps. If the ribbon has a reflective portion, at least a part of the surface of the ribbon which is reflective preferably faces one of the lamps. If the ribbon has a transparent portion, which is preferably colored, at least a part of the transparent portion preferably faces one of the lamps.

The one or more lamps preferably blink when energized. The lamps preferably blink independently one of another, with lamp blinking being controlled by each lamp itself, without a separate blinker unit being provided. When a plurality of lamps are provided, the lamps are preferably of different colors. The colors are selected to be complimentary to the color(s) of the ribbon material(s) from which the meridian-configured loops are formed.

The lamps are preferably longitudinally elongated and of size such that the material forming the meridian-configured loops has transverse width substantially that of the longitudinal elongation of the lamps. Most preferably, the ribbon has an at least partially metalized surface or surface portion, to present a shiny appearance, or is otherwise treated to provide a shiny appearance. The ribbon is most desirably sufficiently stiff and yet sufficiently malleable as to be preferably essentially self-supporting when formed into a meridian-configured loop.

In another of its aspects this invention embraces a method for visually signaling location of gift package by providing a plurality of meridian-configured loops connected together to define a generally open interior within the meridian-configured loops, positioning at least one preferably blinking electrical lamp within the open interior, providing at least one battery or other source of power for powering the lamp(s), connecting the battery to the lamp(s) with wire of sufficient length that the battery may reside within the interior of a rectangular gift package, hidden from view, while the meridian-configured loops and lamp(s) may reside on the upper exterior of the package. The package may have edge length five (5) or even ten (10) times that of the diameter of the spherical shape(s) into which the meridian-configured loops have been formed. Preferably the lamp(s) self-energizes into a blinking state when powered.

In another of its aspects, the invention may be practiced without a battery by providing connection for the lamps directly to a source of electrical power such as house current.

DESCRIPTION OF THE PREFERRED EMBODIMENTS

AND BEST MODE KNOWN FOR PRACTICING THE INVENTION IN ACCORDANCE WITH 35 USC 112

Figure 1:
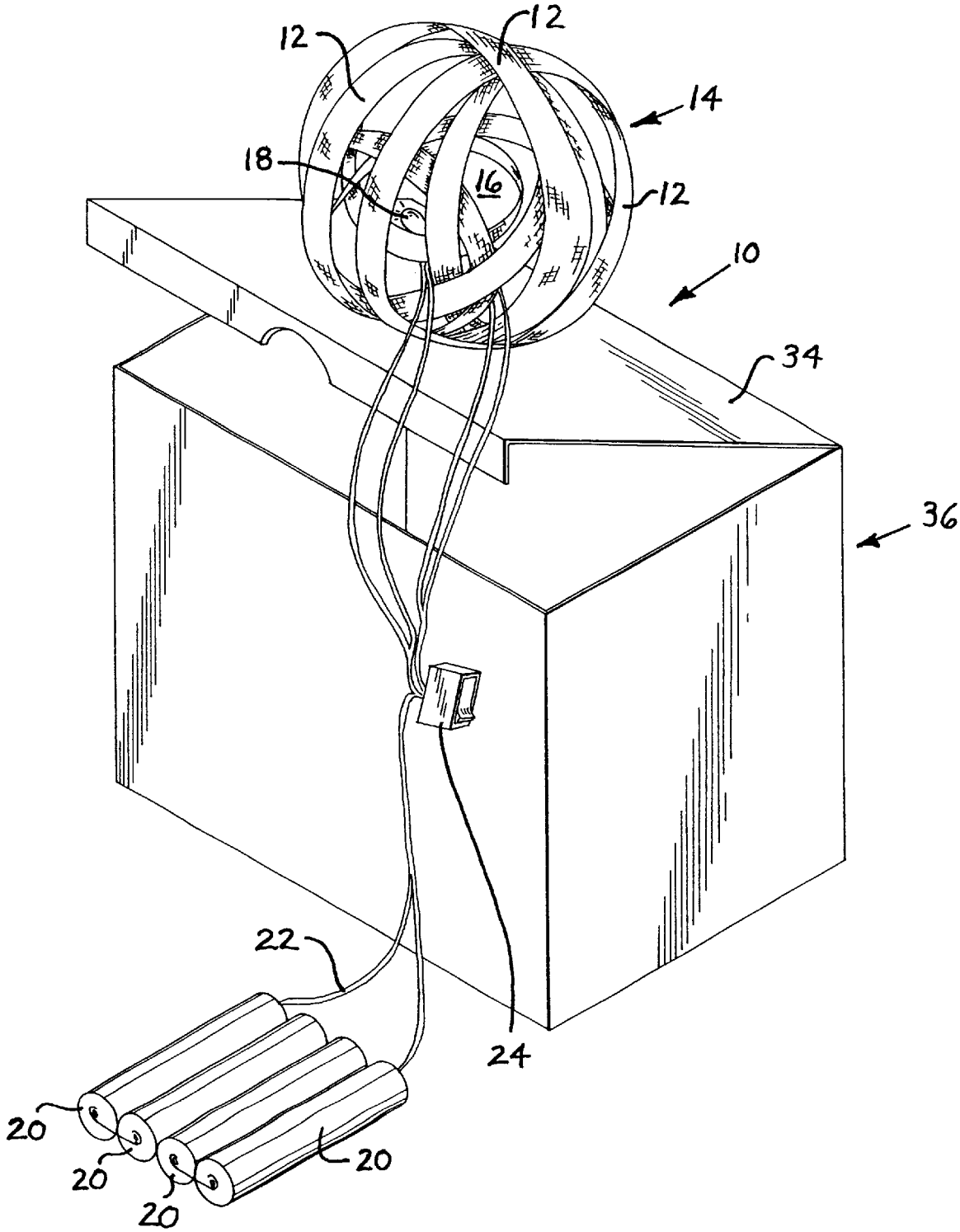
FIG. 1 is an isometric view of a decorative article manifesting aspects of the invention, showing the article connected to a gift package which is partially open, with a switch and batteries, which are normally concealed within the package when in use, being depicted outside the package.

Referring to the drawings in general and to FIG. 1 in particular, an article for providing decorative addition to gift packages embodying aspects of the invention is designated generally 10 and includes a plurality of preferably meridian-configured loops, each meridian-configured loop of which has been designated 12, connected together to define a generally open interior of generally spherical shape where the plurality of meridian-configured loops is collectively designated 14. The open interior within the meridian-configured loops is designated by numerical indicator 16 in FIG. 1.

Article 10 further preferably includes at least one electrical lamp 18 within open interior 16 where lamp 18 is connected to at least some of meridian-configured loops 12.

A plurality of batteries, each battery of which has been designated 20 in FIG. 1, are provided to power lamp 18. Most desirably lamp 18 is a conventional miniature Christmas tree lamp rated for 3.5 volts powered by four conventional AA batteries connected in series in the manner depicted in FIG. 1. Batteries 20 in series are connected via a wire 22 to one or more lamps 18 in the open interior 16 within meridian-configured loops 12. A switch 24 is preferably provided to control energization of lamp(s) 18 by batteries 20.

Figure 3:
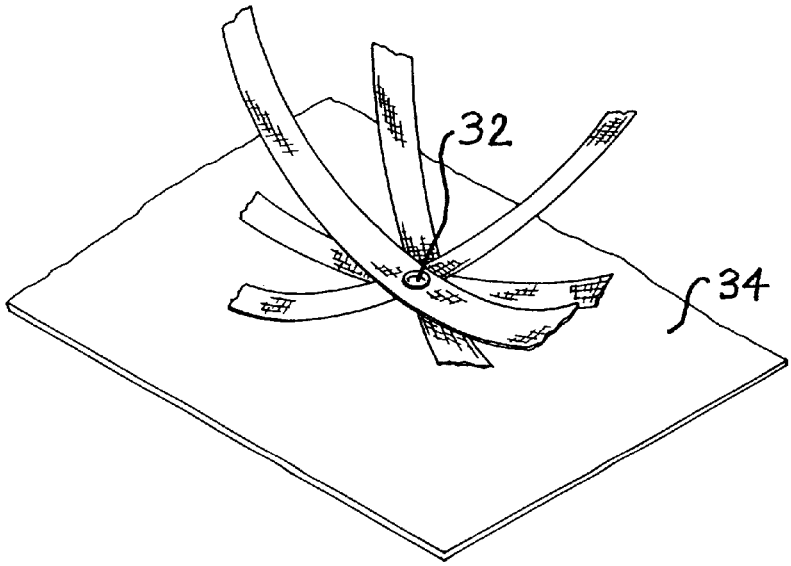
FIG. 3 is a broken isometric view of opaque meridian-configured ribbon loops forming a portion of the decorative article manifesting aspects of the invention, at a location of common securement of the meridian-configured loops one to another and a surface of a gift package, with a portion of the gift package surface also being shown.

Meridian-configured loops 12 are preferably secured together by a tack or other mechanical means where the meridian-configured loop securement means is designated 32 in FIG. 3.

FIG. 3 also depicts a broken away portion of a top 34 of the gift package illustrated generally in FIG. 1 and denoted generally there as 36. The tack or other means 32 provided for securing meridian-configured loops 12 together is preferably plastic and includes a barb so that when the tack is inserted through a collection of the facingly contacting meridian-configured loops 12, in the manner indicated in FIG. 3, and pushed downwardly towards package top 34 illustrated in FIG. 3, the barb portion of tack 32 preferably passes through the preferably facingly contacting meridian-configured loops 12 and through the preferably cardboard or pasteboard package top 34. This retains the plurality of meridian-configured loops 14 and one or more lamps 18 located therewithin in position on top of the gift package 36, without damage to the contents of gift package 36.

Each meridian-configured loop 12 is preferably formed of a self-supporting, semi-rigid strip of ribbon-like material which is sold under the trademark FANCY RIBBON and is made by Plus Mark, Inc., in Greeneville, Tenn. Alternatively, and equally desirably, each meridian-configured loop 12 may be formed of a ribbon material sold as Model No. AU-5053 by Michaels Stores of Irving, Tex. These materials are available in stores selling greeting cards, gift-wrap paper, ribbons, bows and the like.

These materials from which meridian-configured loops 12 are preferably formed are highly reflective and have a metalized or even metallic appearance thereby providing a very shiny surface so that when one or more lamps 18 are illuminated within open interior 16 of the plurality of meridian-configured loops 14, an aesthetically highly pleasing appearance is obtained. This results from the configuration of the plurality of meridian-configured loops 14 in combination with lamp(s) 18 whereby some of the light emitted from a lamp 18 goes directly to the eye of a viewer, as indicated schematically by arrow A in FIG. 2, while other light emitted by a lamp 18 is reflected by at least one surface of at least one of the meridian-configured loops 12 directly to the viewer's eye; this is denoted by arrow B in FIG. 2.

Preferably, meridian-configured loops 12 are nearly opaque and highly reflective. As a result, the perceived light pattern and appearance created by article 10 varies as an observer changes position relative to article 10. Similarly, if an observer is stationary and article 10 is moved, the aesthetically pleasing light pattern perceived by the observer changes. In some instances, depending on the material(s) chosen for meridian-configured loops 12, the surface characteristic(s) of the material and the color(s) and intensity of lamp(s) 18, a nearly kaleidoscopic effect can result.

As apparent from FIG. 1, at least some of meridian-configured loops 12 are preferably of different sizes; meridian-configured loops 12 are preferably connected together preferably facingly at the position of attachment as illustrated in FIG. 3. Meridian-configured loops 12 may be twisted if desired and are preferably connected together at a common location by securing means 32.

As further illustrated in FIG. 1, some of meridian-configured loops 12 are preferably located in vertical planes. Those vertical planes are preferably at random angles one to another so as to provide a highly random, natural appearance for plurality 14 of meridian-configured loops 12, with the meridian-configured loops presenting an appearance at least somewhat suggestive of a surrealistic, almost celestial body.

Meridian-configured loops 12 are preferably made from material strips having essentially unlimited length but finite width, and have thickness which is minimal relative to their width. Width of the strips from which meridian-configured loops 12 are formed may range widely, depending upon the aesthetic effect desired. In one suitable practice of the invention, width of the strips forming meridian-configured loops 12 may be from about one sixteenth (1/16th) of an inch to about two (2) inches. It is not necessary that width of the material from which meridian-configured loops 12 is formed be constant; material width can vary within a given meridian-configured loop or from loop to loop or both.

Lamps 18 preferably blink inherently when they are energized; there is no separate blinking unit in the preferred practice of the invention.

Figure 2:
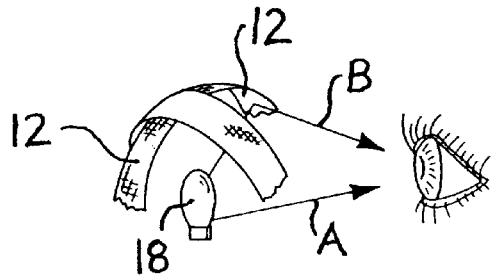
FIG. 2 is a schematic view depicting paths of direct and reflected light emanating from a decorative article in accordance with the invention when a lamp portion of the article is illuminated.

As visible in FIG. 2 and partially visible in FIG. 1, lamps 18 are longitudinally elongated and are of dimensions such that the material forming meridian-configured loops 12 has transverse width substantially that of the longitudinal elongation of lamps 18. The relative stiffness yet malleable characteristic of the material(s) from which meridian-configured loops 12 are preferably formed means that those meridian-configured loops are essentially self-supporting.

In addition to the apparatus illustrated in the drawings, the invention provides a method for visually signaling location of a gift package by providing a plurality of meridian-configured loops connected together to define a preferably sphere-like shape or envelope having a generally open interior within the meridian-configured loops as illustrated generally in FIG. 1. The plurality of meridian-configured loops are positioned to define the sphere-like shape or envelope proximate to a gift package, preferably on the top of the gift package as illustrated in FIG. 1, whose location is to be signaled. At least one electrical lamp, preferably capable of blinking, is positioned within the open interior defined by the meridian-configured loops and a battery or other source is preferably provided for powering the lamp (s). The battery may be connected with the lamp(s) via a wire of sufficient length so that the battery may reside within the interior of a rectangular gift package, hidden from view, and the meridian-configured loops and the lamp(s) may be positioned on the upper exterior of the package. This provides great flexibility for the user of the article.

While the invention has been described with reference to battery power, the invention is not limited to use of batteries to power the electrical lamps. Light-emitting diodes and other self-powered illuminating devices may be used. House current may be used to provide energy for the illumination function.

I claim the following:

1. An article for providing decorative addition to gift packages comprising:

a plurality of meridian-configured loops connected together to define a generally open interior within said meridian-configured loops, at least some of said meridian-configured loops being of different sizes, the largest size ones of said meridian-configured loops defining a sphere-like envelope, said meridian-configured loops consisting of ribbon, said ribbon having a surface portion which is highly reflective respecting visible light;

at least one electrical lamp in said open interior within said meridian-configured loops and connected to at least one of said meridian-configured loops;

least one battery for powering said at least one lamp;

wire connecting said at least one battery with said at least one lamp, of sufficient length that said at least one battery may reside within the interior of a rectangular gift package hidden from view and said meridian-configured loops and said at least one lamp may be positioned on the upper exterior of said package; and switch means connected to said wire for selectable interrupting electrical connection of said at least one battery and said at least one lamp.

2. An article for providing decorative addition to gift packages, comprising:

a plurality of meridian-configured loops connected together to define a generally open interior within said meridian-configured loops at least some of said meridian-configured loops defining a sphere-like envelope, said meridian-configured loops consisting of ribbon, said ribbon being at least partially translucent;

at least one electrical lamp in said open interior within said meridian-configured loops and connected to at least one of said meridian-configured loops;

at least one battery for powering said at least one lamp;

wire connecting said at least one battery with said at least one lamp, of sufficient length that said at least one battery may reside within the interior of a rectangular gift package hidden from view and said meridian-configured loops and said at least one lamp may be positioned on the upper exterior of said package; and switch means connected to said wire for selectably interrupting electrical connection of said at least one battery and said at least one lamp.

3. The article according to claim 2 wherein at least a portion of said translucent part of said ribbon directly faces said at least one lamp.

4. The article of claim 2 wherein said lamps are longitudinally elongated and material forming said meridian-configured loops has transverse width substantially that of longitudinal elongation of said lamps.

5. An article for providing decorative addition to gift packages comprising:

a plurality of meridian-configured loops connected together to define a generally open interior within said meridian-configured loops at least some of said meridian-configured loops defining a sphere-like envelope said meridian-configured loops consisting of ribbon, at least a part of the surface of said ribbon being reflective;

at least one electrical lamp in said open interior within said meridian-configured loops and connected to at least one of said meridian-configured loops;

at least one battery for powering said at least one lamp;

wire connecting said at least one battery with said at least one lamp, of sufficient length that said at least one battery may reside within the interior of a rectangular gift package hidden from view and said meridian-configured loops and said at least one lamp may be positioned on the upper exterior of said package; and switch means connected to said wire for selectable interrupting electrical connection of said at least one battery and said at least one lamp.

6. The article according to claim 5 wherein at least a portion of said reflective part of said ribbon surface faces said at least one lamp.

7. An article for providing decorative addition to gift packages, comprising:

a plurality of meridian-configured loops connected together to define a generally open interior within said meridian-configured loops, at least some of said meridian-configured loops defining a sphere-like envelope, said meridian-configured loops consisting of ribbon, said ribbon being metallic;

at least one electrical lamp in said open interior within said meridian-configured loops and connected to at least one of said meridian-configured loops;

at least one battery for powering said at least one lamp;

wire connecting said at least one battery with said at least one lamp, of sufficient length that said at least one battery may reside within the interior of a rectangular gift package hidden from view and said meridian-configured loops and said at least one lamp may be positioned on the upper exterior of said package; and switch means connected to said wire for selectable interrupting electrical connection of said at least one battery and said at least one lamp.

8. An article for providing decorative addition to gift packages, comprising:

a plurality of meridian-configured loops connected together to define a generally open interior within said meridian-configured loops, at least some of said meridian-configured loops defining a sphere-like envelope, said meridian-configured loops consisting of ribbon, said ribbon having a metalized surface portion;

at least one electrical lamp in said open interior within said meridian-configured loops and connected to at least one of said meridian-configured loops;

at least one battery for powering said at least one lamp;

wire connecting said at least one battery with said at least one lamp, of sufficient length that said at least one battery may reside within the interior of a rectangular gift package hidden from view and said meridian-configured loops and said at least one lamp may be positioned on the upper exterior of said package; and switch means connected to said wire for selectable interrupting electrical connection of said at least one battery and said at least one lamp.

* * * * *